US006280164B1

(12) United States Patent
Kalt et al.

(10) Patent No.: US 6,280,164 B1
(45) Date of Patent: Aug. 28, 2001

(54) METHOD AND APPARATUS FOR TEMPERATURE STABILIZATION IN GEAR PUMPS

(75) Inventors: Stefan Kalt, Spreitenbach; Michael Heinen, Zurich, both of (CH)

(73) Assignee: Maag Pump Systems Textron AG, Zurich (CH)

( * ) Notice: Subject to any disclaimer, the term of this patent is extended or adjusted under 35 U.S.C. 154(b) by 0 days.

(21) Appl. No.: 09/188,175

(22) Filed: Nov. 9, 1998

(30) Foreign Application Priority Data

Nov. 7, 1997 (EP) ..... 97119483

(51) Int. Cl.[7] ..... F03C 2/00

(52) U.S. Cl. ..... 418/1; 418/83; 418/85; 418/94; 418/102; 418/206.3

(58) Field of Search ..... 418/102, 206.3, 418/85, 94, 83, 1

(56) References Cited

U.S. PATENT DOCUMENTS

| | | | | |
|---|---|---|---|---|
| 3,711,228 | * | 1/1973 | Foley | 418/85 |
| 4,395,207 | * | 7/1983 | Manttari et al. | 418/102 |
| 4,541,792 | | 9/1985 | Zakic . | |
| 4,955,352 | * | 9/1990 | Takeda | 418/85 |
| 5,292,237 | | 3/1994 | Orimo et al. . | |
| 5,468,131 | * | 11/1995 | Blume et al. | 418/94 |
| 5,924,854 | * | 7/1999 | Blume et al. | 418/83 |

FOREIGN PATENT DOCUMENTS

| | | | | |
|---|---|---|---|---|
| 2923175 | * | 12/1980 | (DE) | 418/102 |
| 37 30 991 A1 | | 4/1989 | (DE) . | |
| 0 607 999 A2 | | 2/1994 | (EP) . | |
| 0 715 078 A2 | | 6/1996 | (EP) . | |
| 0 753 665 A1 | | 1/1997 | (EP) . | |
| 675621 | | 4/1950 | (GB) . | |
| 2 047 810 | | 12/1980 | (GB) . | |
| 55-123316 | * | 9/1980 | (JP) | 418/85 |
| 56-88990 | * | 7/1981 | (JP) | 418/85 |
| 8-004662 | | 1/1996 | (JP) . | |

* cited by examiner

*Primary Examiner*—Thomas Denion
*Assistant Examiner*—Theresa Trieu
(74) *Attorney, Agent, or Firm*—Crowell & Moring LLP

(57) ABSTRACT

A method stabilizes the temperature in a gear pump lubricated with material to be delivered. At least one housing part has at least two slide bearings in which shafts are mounted and are lubricated by medium to be delivered. A medium is adjusted in a temperature stabilizer to a predetermined temperature and then flows firstly through the housing part and secondly through shafts and/or slide bearings to stabilize the temperature.

8 Claims, 2 Drawing Sheets

METHOD AND APPARATUS FOR TEMPERATURE STABILIZATION IN GEAR PUMPS

BACKGROUND OF THE SUMMARY

This application claims the priority of European application No. 97 119 483.2, filed Nov. 7, 1997, the disclosure of which is expressly incorporated by reference herein.

The present invention relates to a method and apparatus for stabilizing the temperature in a gear pump lubricated with material to be delivered.

When gear pumps equipped with slide bearings and lubricated by the material to be delivered are used to deliver polymers, the temperature of the material being delivered is of great significance because if, the temperature is too low, the viscosity is too high, and decomposition phenomena can occur at temperatures that are too high. Therefore, an attempt is made to keep the temperature of the medium being delivered within a certain range. This makes it possible significantly to increase the size of the operating window of the gear pump.

Hence, known heat exchangers are provided in the housing of the gear pump and in the shaft for temperature stabilization. The heat exchanger in the housing is connected to a heating assembly by a first system of lines and the heat exchanger in the shaft is connected to a cooling device by a second system of lines. The housing that gives off heat to the environment during operation is kept at a preset temperature by the heating assembly. The cooling assembly compensates for the heat which is generated and released by friction between the shaft and the bearing, thereby avoiding local overheating of the material being delivered.

The known method for temperature adjustment is, however, cumbersome and associated with correspondingly high costs.

SUMMARY OF THE INVENTION

Hence, an object of the present invention is to provide a method that does not suffer from the above disadvantages.

This object has been achieved by providing that a medium is adjusted in a temperature stabilizer to a predetermined temperature; medium firstly flows through the (at least one) housing part and secondly through the shafts and/or slide bearings to stabilize the temperature.

Because the temperature stabilizer used for stabilizing the temperature in gear pumps is connected to both the heat exchanger in the shaft and/or in the slide bearing as well as to the heat exchanger in the housing, utilizing the invention the system is advantageously considerably simplified, as reflected particularly in lower costs.

BRIEF DESCRIPTION OF THE DRAWINGS

These and further objects, features and advantages of the present invention will become more apparent from the following detailed description of a currently preferred embodiments when taken in conjunction with the accompanying drawings wherein.

DETAILED DESCRIPTION OF THE DRAWINGS

Figure 1:
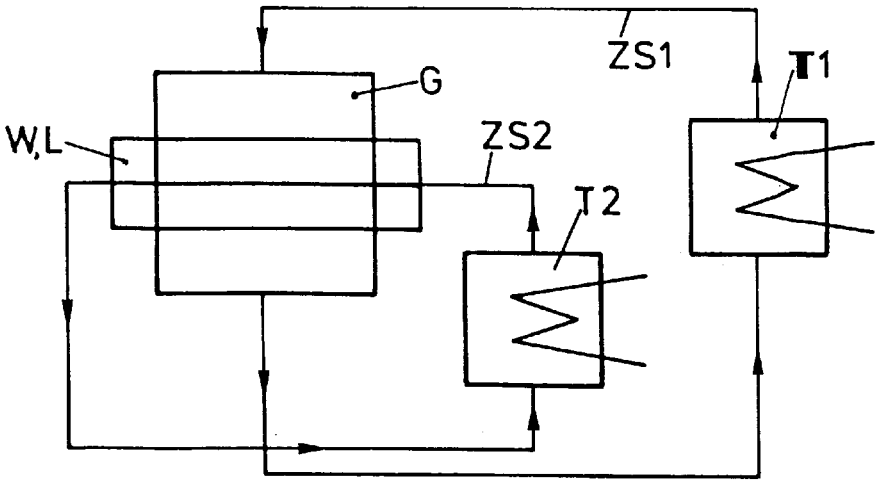
FIG.1 PRIOR ART
FIG. 1 is a schematic diagram of a known system for stabilizing the temperature of the material being delivered with two temperature-stabilizing assemblies.

In FIG. 1, a gear pump consists of at least one housing part G containing in particular two shafts W, each of which is rotatably mounted in at least one and preferably two slide bearings L. For further information about the construction of gear pumps, the reader is referred for example to the Maag Pocket-Book, second edition, 1985, pages 279 et seq.

As mentioned above, gear pumps are especially suited for delivering highly viscous liquids such as, for example, polymer melts. It is important to note in this connection that the temperature of the material being delivered corresponds to a certain value in as stable a manner as possible in which neither decomposition like that which occurs at high temperatures nor stoppage of the gear pump caused, for example, by seizing of the slide bearings, can be caused by a viscous material to be delivered, something that is possible if the temperature of the material being delivered is too low. For this purpose, heat exchangers are provided in known fashion in housing G and in shaft W of the gear pump.

The heat exchangers are connected by systems of lines ZS1 and ZS2 with temperature stabilizers T1, T2. In temperature stabilizers T1, T2, a medium M is heated or cooled to a desired temperature and supplied to the heat exchanger in shaft W or in housing G with the aid of systems of lines ZS1, ZS2.

The known system has the disadvantage that two temperature stabilizers T1, T2 are also provided for the separate systems of lines ZS1, ZS2. The advantage of an independent temperature setting for shaft W and housing G is offset by uncommonly high costs for temperature stabilizers T1, T2.

Figure 2:
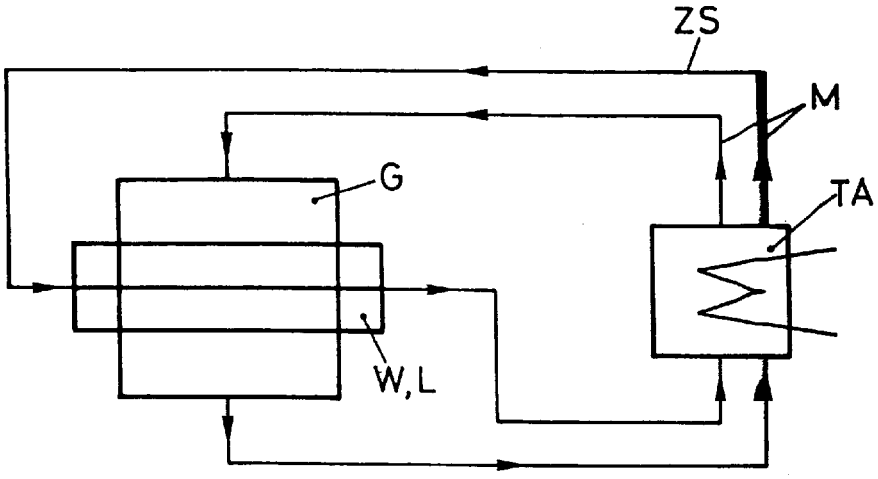
FIGS. 2 to 4 are schematic diagrams of various systems according to the present invention for stabilizing the temperature of the material being delivered using a temperature stabilizer.
Figure 3:
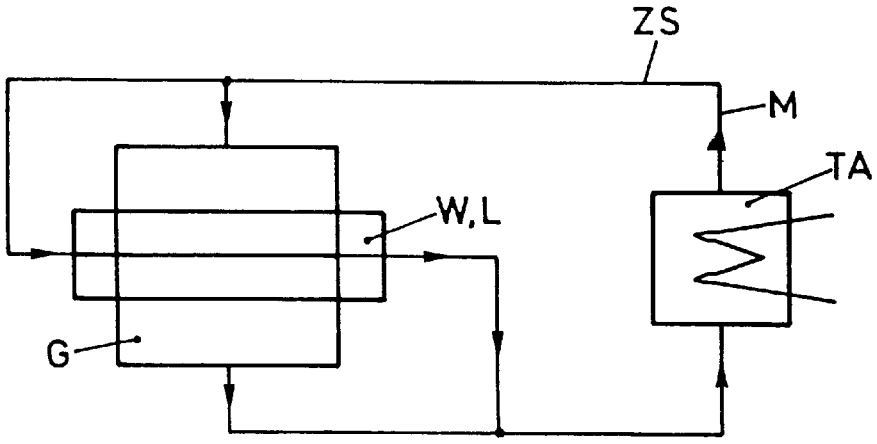
Figure 4:
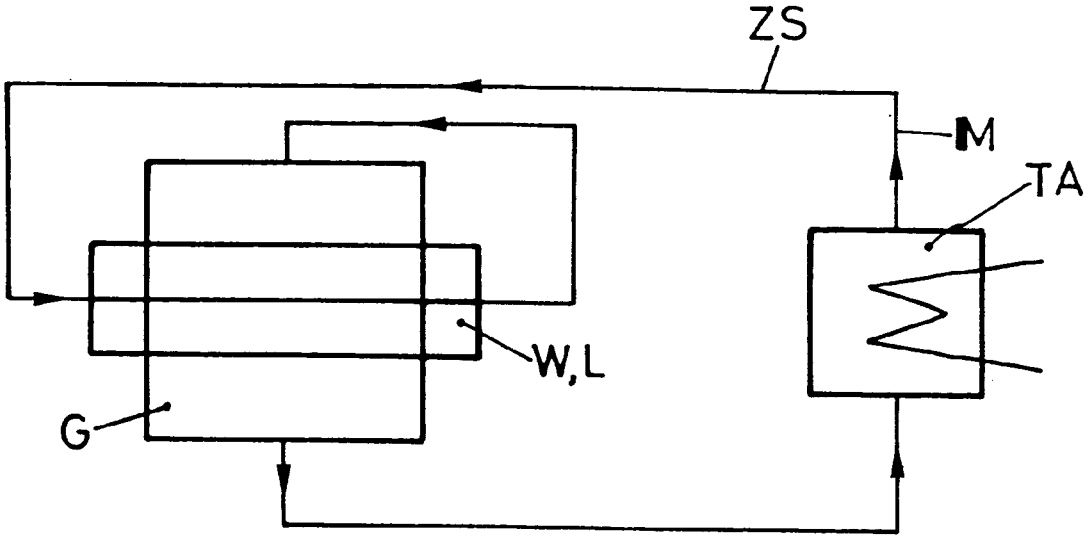

FIGS. 2 to 4 show various devices according to the present invention for setting and stabilizing the temperature of material M to be delivered. All three embodiments use a single temperature stabilizer TA, to which the systems of lines ZS linked to the heat exchangers in housing G or in shaft W are connected in different ways. Thus, FIG. 2 shows a system in which the heat exchangers are connected in parallel with temperature stabilizer TA, i.e. medium M in systems of lines ZS has the same temperature upstream from the corresponding heat exchanger.

Similarly, the embodiment according to FIG. 3 is also a parallel arrangement of heat exchangers. However, by bringing the lines together upstream of the heat exchangers, thorough mixing and hence a temperature equalization of media M takes place upstream of temperature stabilizer TA.

Finally, FIG. 4 shows an embodiment in which a series arrangement of the two heat exchangers is provided, in which medium M, starting at temperature stabilizer TA, is initially guided through the heat exchanger in the shaft and then through the heat exchanger in housing G. In this embodiment in particular, advantage is taken of the possibility of transporting the exhaust heat produced in shaft W through medium M into housing G, i.e. shaft W and housing G act as a temperature stabilizer.

It should be noted that in another embodiment of the invention, instead of the heat exchanger in shaft W, a corresponding heat exchanger is also used in slide bearing L in order to avoid overheating. In addition, a combination of heat exchangers simultaneously in shaft W and in slide bearing L is contemplated.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Method for stabilizing a temperature in a gear pump, consisting of at least one housing part having at least two slide bearings in which shafts are mounted and lubricated by the medium being delivered, comprising:

adjusting only a separate medium in a single temperature stabilizer to a predetermined temperature; and flowing a second medium adjusted to the predetermined temperature from the single temperature stabilizer first through the at least one housing part and second through at least one of the shafts to stabilize temperature of the material to be delivered.

2. Method according to claim 1, wherein the at least one housing part and the at least one of the shafts and slide bearings are traversed in parallel by the medium.

3. Method according to claim 1, wherein the at least one housing part and the at least one of the shafts and slide bearings are traversed by the medium independently of one another.

4. Method according to claim 1, wherein, starting at the temperature stabilizer, initially at least one of the shafts and the slide bearings and then the at least one housing part are traversed by the medium.

5. Apparatus for stabilizing a temperature in a gear pump lubricated with material to be delivered by the gear pump, the gear pump comprising at least one housing part, at least two shafts, and at least two slide bearings, wherein the at least one housing part and at least one of the shafts and the slide bearings have heat exchanging line systems, and a single temperature stabilizer is operatively connectable by a supply line system with the heat exchanging line systems such that temperature of only a separate medium is adjusted to a predetermined temperature in the single temperature stabilizer before being flowed to the heat exchanging line systems.

6. Apparatus according to claim 5, wherein the heat exchanging line systems through the at least one housing part and the at least one of the shafts and the slide bearings are connected in parallel to the supply line system.

7. Apparatus according to claim 6, wherein the heat exchanging line systems through the at least one housing part and the at least one of the shafts and the slide bearings are connected to an outlet of the temperature stabilizer.

8. Apparatus according to claim 5, wherein the heat exchanging line systems through the at least one housing part and the at least one of the shafts and the slide bearings are connected in series and operatively connected to the supply line system.

* * * * *